US012049797B1

(12) United States Patent
Post et al.

(10) Patent No.: US 12,049,797 B1
(45) **Date of Patent: *Jul. 30, 2024**

(54) LINEAR WELLHEAD CONNECTION SYSTEMS AND METHODS

(71) Applicant: FORUM US, INC., Houston, TX (US)

(72) Inventors: Steven Post, Weatherford, TX (US); Alex Paul Sheehan, Houston, TX (US); Roger Lane Suter, Katy, TX (US)

(73) Assignee: FORUM US, INC., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/436,640

(22) Filed: Feb. 8, 2024

Related U.S. Application Data

(63) Continuation of application No. 18/196,702, filed on May 12, 2023, now Pat. No. 11,905,781.

(51) Int. Cl.

| | |
|---|---|
| ***E21B 43/26*** | (2006.01) |
| ***E21B 17/05*** | (2006.01) |
| ***E21B 17/20*** | (2006.01) |
| ***E21B 19/16*** | (2006.01) |
| ***E21B 33/03*** | (2006.01) |

(52) U.S. Cl.
CPC ..... *E21B 33/03* (2013.01); *E21B 17/05* (2013.01); *E21B 17/20* (2013.01); *E21B 19/16* (2013.01)

(58) Field of Classification Search
CPC ..... E21B 33/03; E21B 17/05; E21B 17/02; E21B 19/16; E21B 43/2607; E21B 43/26
See application file for complete search history.

(56) References Cited

U.S. PATENT DOCUMENTS

| | | | |
|---|---|---|---|
| 2,753,940 | A | 7/1956 | Bonner |
| 10,466,719 | B2 | 11/2019 | Kibler et al. |
| 10,662,749 | B1 | 5/2020 | Hill et al. |
| 10,738,580 | B1 | 8/2020 | Fischer et al. |
| 10,851,635 | B1 | 12/2020 | Fischer et al. |
| 11,053,758 | B2 | 7/2021 | Fischer et al. |
| 11,142,972 | B1 | 10/2021 | Fischer et al. |
| 11,180,979 | B1 | 11/2021 | Leuchtenberg et al. |
| 11,220,896 | B2 | 1/2022 | Fischer et al. |
| 11,396,799 | B2 | 7/2022 | Johnson et al. |
| 11,401,779 | B2 | 8/2022 | Kuehn et al. |
| 11,434,709 | B2 | 9/2022 | Fischer et al. |
| 11,560,770 | B2 | 1/2023 | Kuehn et al. |
| 11,560,973 | B2 | 1/2023 | Post |
| 11,585,200 | B1 | 2/2023 | Startz et al. |

(Continued)

FOREIGN PATENT DOCUMENTS

WO 2019200083 A1 10/2019

OTHER PUBLICATIONS

"A Universal Wellhead Connection for Wireline, Frac, and Coiled Tubing." FHE FrackLock, www.builtbyfhe.com/fraclock.html, Last Accessed Mar. 17, 2020.

(Continued)

*Primary Examiner* — Taras P Bemko
(74) *Attorney, Agent, or Firm* — Patterson + Sheridan, LLP

(57) ABSTRACT

Linear wellhead connection systems and related methods of pumping fluid into a plurality of wellheads. The linear wellhead connection system uses linear movement of an inlet conduit to transition between multiple discharge conduits that are connected to different wellheads to pump pressurized fluid from a manifold to the different wellheads. The inlet conduit is moveable in a linear direction along a track system relative to the discharge conduits.

20 Claims, 6 Drawing Sheets

(56) References Cited

U.S. PATENT DOCUMENTS

| | | | |
|---|---|---|---|
| 11,591,889 | B2 | 2/2023 | Johnson et al. |
| 11,781,410 | B2 | 10/2023 | Post et al. |
| 2015/0240581 | A1 | 8/2015 | Nicholson |
| 2016/0208570 | A1 | 7/2016 | Ayres et al. |
| 2017/0122060 | A1 | 5/2017 | Dille et al. |
| 2017/0138144 | A1 | 5/2017 | Christopherson et al. |
| 2017/0275980 | A1 | 9/2017 | Kajaria |
| 2017/0314379 | A1 | 11/2017 | Guidry |
| 2018/0347286 | A1 | 12/2018 | Scott et al. |
| 2019/0071946 | A1 | 3/2019 | Painter et al. |
| 2019/0302810 | A1 | 10/2019 | Kibler et al. |
| 2020/0131877 | A1 | 4/2020 | Guidry |
| 2021/0054727 | A1 | 2/2021 | Floyd |
| 2021/0131247 | A1 | 5/2021 | Ungchusri et al. |
| 2021/0148500 | A1 | 5/2021 | Farquharson et al. |
| 2021/0198953 | A1 | 7/2021 | Robinson et al. |
| 2021/0372548 | A1 | 12/2021 | Post |
| 2022/0018235 | A1 | 1/2022 | Post et al. |
| 2022/0082005 | A1 | 3/2022 | Harrel et al. |
| 2022/0127945 | A1 | 4/2022 | Fischer et al. |
| 2022/0154866 | A1 | 5/2022 | Johnson et al. |
| 2022/0268141 | A1 | 8/2022 | Krupa et al. |
| 2022/0372858 | A1 | 11/2022 | Scott et al. |
| 2022/0403725 | A1 | 12/2022 | Harrel et al. |
| 2023/0228353 | A1 | 7/2023 | Post |

OTHER PUBLICATIONS

"Dual-connection fracturing fluid delivery technology", Cameron—A Schlumberger Company, Last Accessed Mar. 13, 2020.

"Dual-connection fracturing fluid delivery technology", Schlumberger, www.slb.com/completions/stimulation/frac-and-flowback-equipment/monoflex-technology. Last Accessed Mar. 13, 2020.

"ExpressKinect™ Wellhead Connection Unit", Halliburton, Published Mar. 2, 2019, www.fracnews.com/2019/03/02/expresskinect-wellhead-connection-unit/, Last Accessed Mar. 13, 2020.

"ExpressKinect™ Wellhead Connection Unit", Halliburton, Published Oct. 2016.

"FHE FracLock Animation", YouTube, FHE USA, Published Sep. 17, 2019, www.youtube.com/watch?v=-5tHO6hvcLk, Last Accessed Mar. 13, 2020.

"FHE FracLock Demonstration", YouTube, Renegade Services, LLC Wireline, Published Sep. 13, 2019, www.youtube.com/watch?v=cPI-AOcCIGA, Last Accessed Mar. 13, 2020.

"Flanged-connection fracturing fluid delivery technology", Cameron—A Schlumberger Company, Last Accessed Mar. 13, 2020.

"Flanged-connection fracturing fluid delivery technology", Schlumberger, www.slb.com/completions/stimulation/frac-and-flowback-equipment/monoline-technology. Last Accessed Mar. 13, 2020.

"FracMaxx™ Big Bore Flowline & QuickLatch™", National Oilweell Varco, Published Aug. 16, 2019, www.youtube.com/watch?v=f_f0w9EmiP4, Last Accessed Mar. 13, 2020.

"Moffat Subsea Stab Connector", Forum Energy Technologies, pp. 1-9, https://forumenergydev.wpengine.com/wp-content/uploads/2019/11/moffat-hot-stab-datasheet.pdf (accessed Jul. 16, 2020).

"The Coflexip® Flexible Line", Technip, Published Sep. 2006, pp. 1-12.

International Search Report and Written Opinion dated Aug. 30, 2021 for International Application No. PCT/US2021/034501.

International Search Report and Written Opinion dated Oct. 8, 2021 for Application No. PCT/US2021/038526.

Invitation to Pay Additional Fees dated Oct. 1, 2021 for Application No. PCT/US2021/038510.

PCT International Search Report and Written Opinion dated Dec. 1, 2021, for International Application No. PCT/US2021/038510.

Roesner, Thomas G., "Solving Inefficiencies Of Fracturing Fluid Delivery", Hart Energy, Published Nov. 2, 2015, www.hartenergy.com/exclusives/solving-inefficiencies-fracturing-fluid-delivery-175588.

Safety Mits, "Zero G Tool Handling System and Trolley", YouTube, Feb. 3, 2016, https://www.youtube.com/watch?v=ZpA428tL38s (last accessed Apr. 29, 2021).

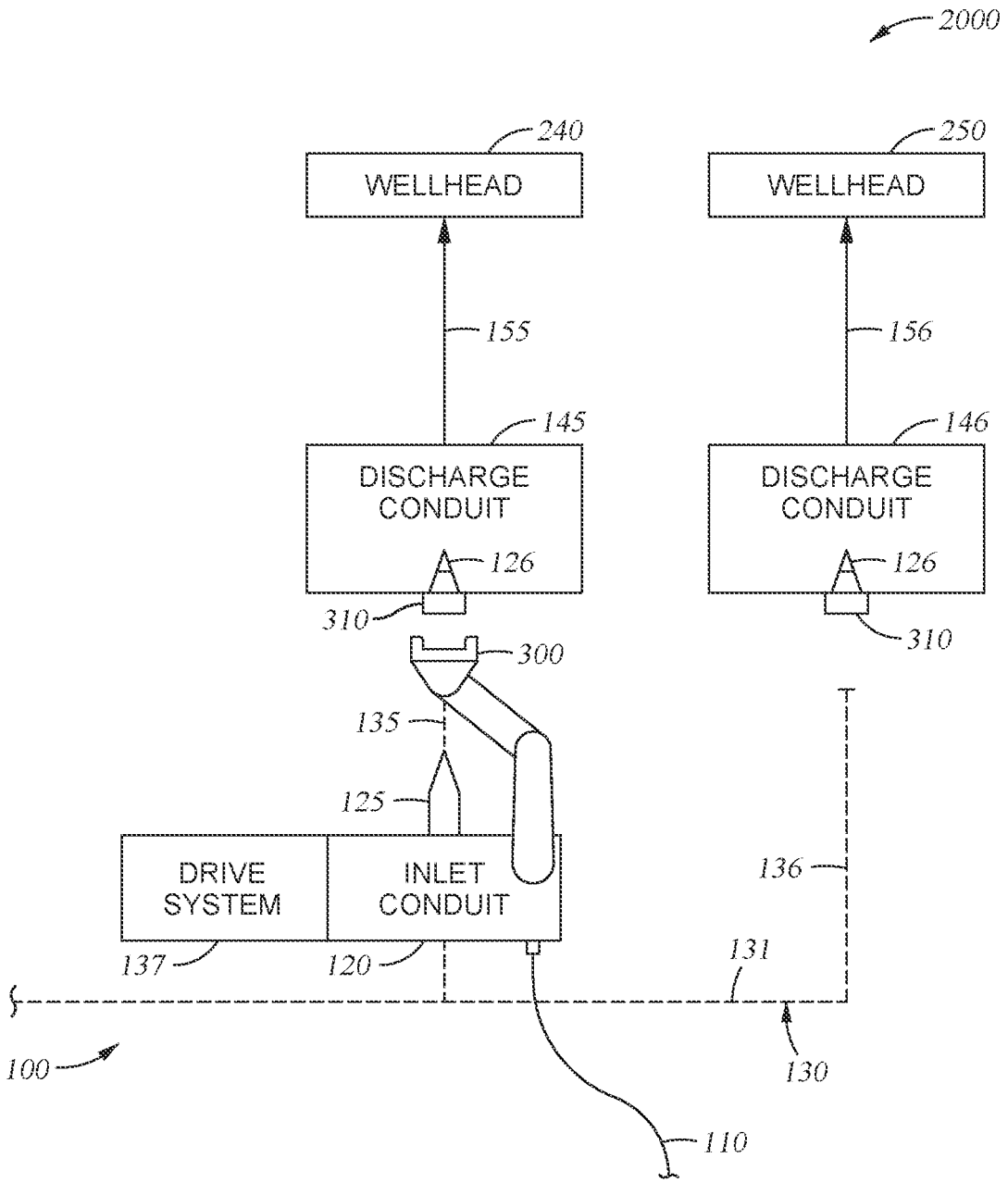
*Fig. 4*
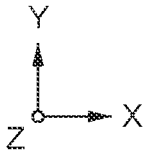

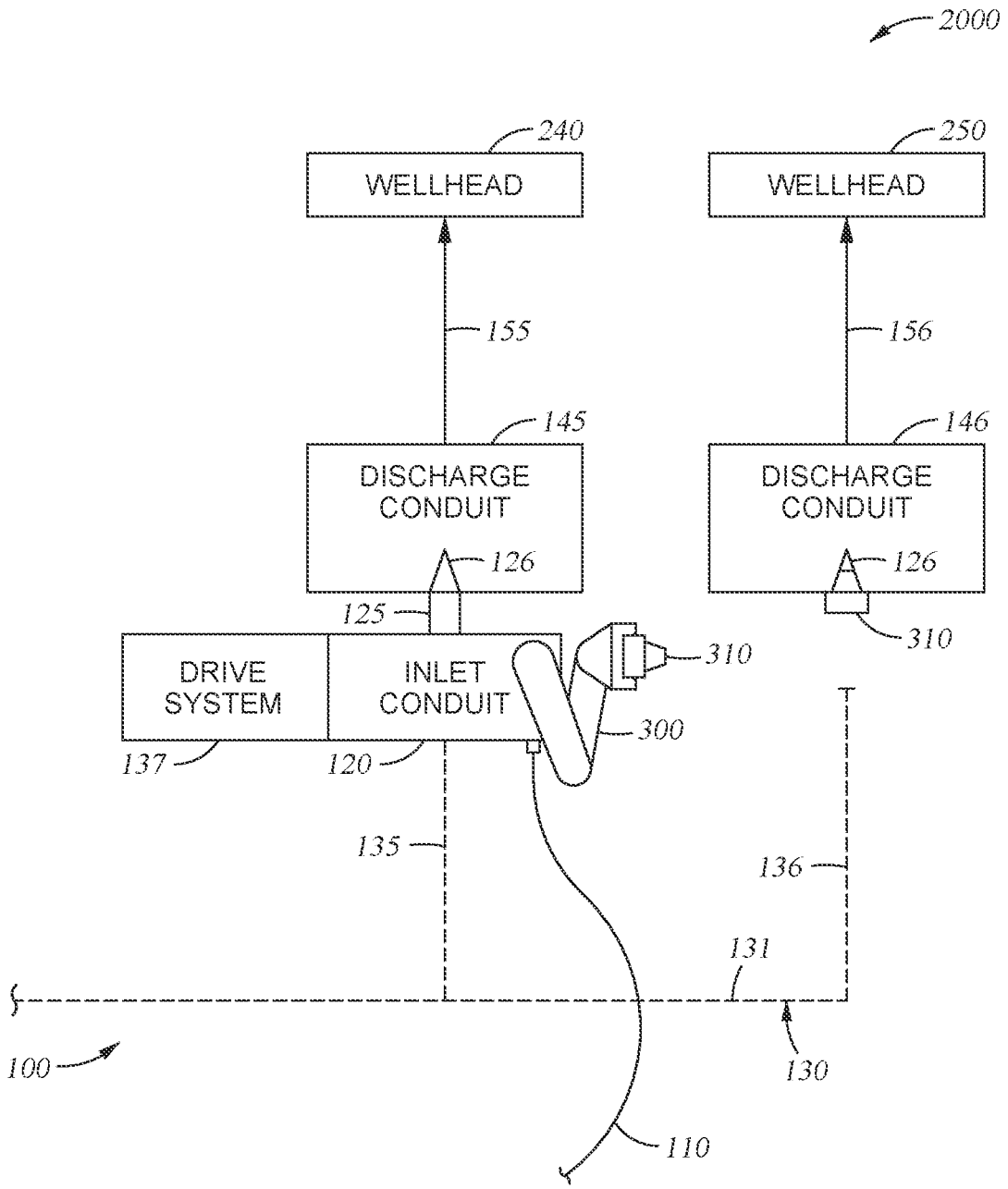
*Fig. 5*
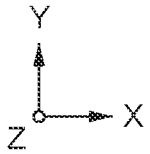

LINEAR WELLHEAD CONNECTION SYSTEMS AND METHODS

CROSS-REFERENCE TO RELATED APPLICATIONS

This application is a continuation of co-pending U.S. patent application Ser. No. 18/196,702, filed May 12, 2023, which is herein incorporated by reference in its entirety.

BACKGROUND

Field

Aspects of the disclosure relate to linear wellhead connection systems, apparatus, methods, and associated components thereof. In one example, the linear wellhead connection systems, apparatus, methods, and associated components thereof uses linear movement of an inlet conduit to transition between multiple discharge conduits that are connected to different wellheads to provide pressurized fluid from a manifold to the different wellheads.

Description of the Related Art

Conventional wellhead connection systems have several drawbacks. For example, conventional wellhead connection systems may require multiple connection points to make a connection between a manifold and several wellheads. These multiple connection points can have multiple lines that are needed to connect to the wellheads, require increased line lengths, and include large numbers of complex connections that are slow to be connected to and from each other. These issues can lead to reduced efficiency, increased costs, increased operational times, increased mobilization of resources, and complexity in design and operations. Each connection is a possible point of failure—possible leak point or catastrophic release. Reducing the number of connections is desirable. Also, conventional systems use valves to isolate the wells during operation, the valves are prone to failure and require stopping the operation for repair.

Therefore, there is a need for wellhead connection systems and methods that can rapidly and effectively establish a connection between a manifold and several wellheads with a minimum number of connections and/or valves.

SUMMARY

In one embodiment, a linear wellhead connection system comprises a plurality of discharge conduits, wherein each discharge conduit is fluidly coupled to at least one wellhead, and wherein each discharge conduit has a receiver; an inlet conduit, wherein the inlet conduit has a connection member engageable with the receiver on each discharge conduit to fluidly couple the inlet conduit to the discharge conduit, and wherein the inlet conduit is moveable relative to each discharge conduit in a linear direction to engage and disengage the connection member of the inlet conduit to and from the receiver of any one of the discharge conduits; at least one of a flexible hose and a rotatable joint fluidly coupled to the inlet conduit, wherein the at least one of the flexible hose and the rotatable joint remains coupled to the inlet conduit when moved in the linear direction; and a pressurized fluid source fluidly coupled to the inlet conduit by the at least one of the flexible hose and the rotatable joint to supply pressurized fluid.

In one embodiment, a method of pumping fluid into a plurality of wellheads comprises moving an inlet conduit linearly along a track system and laterally relative to a plurality of discharge conduits, wherein at least one of a flexible hose and a rotatable joint remains fluidly coupled to the inlet conduit as the inlet conduit moves along the track system; engaging a connection member of the inlet conduit with a receiver of a first discharge conduit of the plurality of discharge conduits to fluidly couple the inlet conduit with the first discharge conduit; and pumping pressurized fluid through the at least one of the flexible hose and the rotatable joint, as well as through the inlet conduit and the first discharge conduit, and into a first wellhead that is fluidly coupled to the first discharge conduit.

BRIEF DESCRIPTION OF THE DRAWINGS

So that the manner in which the above-recited features of the disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

FIG. 4 is a schematic view of the hydraulic fracturing operation with the linear wellhead connection system, according to one embodiment.

FIG. 5 is a schematic view of the hydraulic fracturing operation with the linear wellhead connection system illustrated in FIG. 4, according to one embodiment.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

Aspects of the disclosure relate to linear wellhead connection systems, apparatus, methods, and associated components thereof. In one example, the linear wellhead connection systems, apparatus, methods, and associated components thereof uses linear movement of an inlet conduit to transition between multiple discharge conduits that are connected to different wellheads to provide pressurized fluid from a manifold to the different wellheads.

The present disclosure contemplates that use of terms such as "coupled," "couples", and/or "coupling," can include direct coupling and/or indirect coupling, such as coupling through other components. The present disclosure also contemplates that use of terms such as "coupled," "couples", and/or "coupling," can include but are not limited to connecting, welding, interference fitting, brazing, and/or fastening using fasteners, such as pins, rivets, screws, bolts, and/or nuts. The present disclosure also contemplates that use of terms such as "coupled," "couples", and/or "coupling," can include but are not limited to components being integrally formed together as a unitary body.

Figure 1:
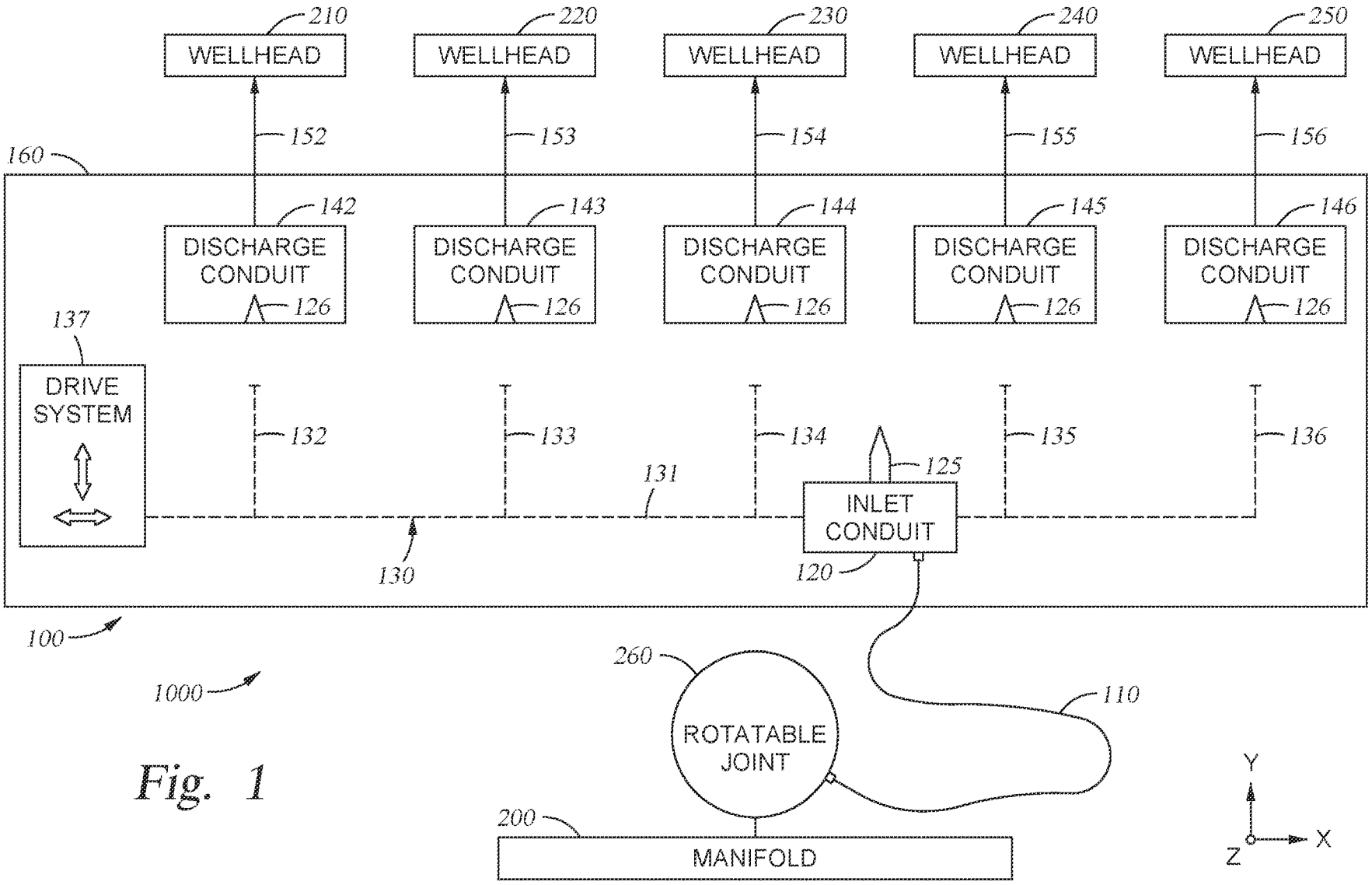
FIG. 1 is a schematic view of a hydraulic fracturing operation with a linear wellhead connection system, and an inlet conduit of the linear wellhead connection system in a first position, according to one embodiment.

FIG. 1 is a schematic view of a hydraulic fracturing operation 1000 with a linear wellhead connection system 100. The linear wellhead connection system 100 directs pressurized fluid from a manifold 200 (e.g. a pressurized fluid source) to a plurality of wellheads 210, 220, 230, 240, 250. Although only five wellheads are shown, the linear wellhead connection system 100 may be configured to direct pressurized fluid to one, two, three, four, five, six, seven, eight, nine, ten, or more wellheads. An optional rotatable joint 260, which may be or comprise a swivel for example, may be used to help direct the pressurized fluid from the manifold 200 to the linear wellhead connection system 100. One or more pumps may be used to pump pressurized fluid to the manifold 200.

The linear wellhead connection system 100 comprises a flexible hose 110. The flexible hose 110 may be a single large bore, high pressure flexible hose. The flexible hose 110 may be a bonded and/or non-bonded hose. Other than at the ends of the flexible hose 110, the body of the flexible hose 110 between the ends does not include any hard metal sections, such as hard metal connections or hard metal line portions.

One end of the flexible hose 110 is shown as being fluidly coupled to the rotatable joint 260 but the end of the flexible hose 110 may be coupled directly to the manifold 200 without the use of the rotatable joint 260. The rotatable joint 260 is fluidly coupled to the manifold 200 and is configured to receive pressurized fluid from the manifold 200 and direct the pressurized fluid to the flexible hose 110. The opposite end of the flexible hose 110 is fluidly coupled to an inlet conduit 120 having a connection member 125, which may be a latch member. The inlet conduit 120 may be in the form of a block member having one or more fluid conduits formed through the block member. A fluid conduit is disposed through the inlet conduit 120 and the connection member 125 such that pressurized fluid from the flexible hose 110 may flow through the inlet conduit 120 and the connection member 125.

The flexible hose 110 can be rapidly and easily connected to and from the rotatable joint 260 and/or the manifold 200, as well as to and from the inlet conduit 120. The use of the flexible hose 110 reduces the number of connections that are required for conventional connection systems that include hard metal connections and lines. The use of the flexible hose 110 allows the inlet conduit 120 to connect to and from multiple discharge conduits (as further described below) that are spaced apart from each other horizontally by allowing the flexible hose 110 to bend to accommodate for differences in the distance of the discharge conduits relative to each other and/or relative to the inlet conduit 120. In one embodiment, two, three, four, five, or more sets of flexible hoses 110, rotatable joints 260, manifolds 200, and/or inlet conduits 120 can be used as part of the linear wellhead connection system 100.

The inlet conduit 120 is located on a track system 130 of the linear wellhead connection system 100. The track system 130 comprises a primary track 131 and a plurality of secondary tracks 132, 133, 134, 135, 136 that extend from the primary track 131. Although the track system 130 is described as having tracks, the track system 130 may comprise tracks, rails, and/or guides. The track system 130 may comprise any type of mechanism configured to direct and/or move the inlet conduit 120. The inlet conduit 120 can move linearly, e.g. in a straight line, along the primary track 131 (along the X-axis), as well as linearly, e.g. in a straight line, along any of the secondary tracks 132, 133, 134, 135, 136 (along the Y-axis). The flexible hose 110 remains coupled to the inlet conduit 120 as the inlet conduit 120 moves along the track system 130.

The track system 130 further comprises a drive system 137 configured to move the inlet conduit 120 along the primary track 131 and/or along the secondary tracks 132, 133, 134, 135, 136. The drive system 137 may be a lead screw or a winch/cable mechanism used to pull and/or push the inlet conduit 120 along tracks, rails, and/or guides. The drive system 137 may be directly attached to the track system 130 and/or to the inlet conduit 120 itself. For example, the drive system 137 may be a remote controlled wheel/motor assembly to which the inlet conduit 120 is coupled to move the inlet conduit 120 to the various locations, with or without the use of the track system 130.

The secondary tracks 132, 133, 134, 135, 136 are arranged to direct the inlet bock 120 into and out of engagement with a plurality of discharge conduits 142, 143, 144, 145, 146. The discharge conduits 142, 143, 144, 145, 146 may be in the form of block members having one or more fluid conduits formed through the block members. Each discharge conduit 142, 143, 144, 145, 146 has a corresponding receiver 126, such as a latch receiver, that engages with the connection member 125 on the inlet conduit 120. When the connection member 125 and the receiver 126 are engaged, pressurized fluid flows through the inlet conduit 120 and into the discharge conduit 142, 143, 144, 145, 146 that the inlet conduit 120 is coupled to. The connection member 125 and the receiver 126 together may comprise an electric, hydraulic, or manual coupling system configured to connect and disconnect the connection member 125 and the receiver 126 to and from each other. The components of the linear wellhead connection system 100 are configured such that an operator from a remote location (e.g. 100-200 feet or more away from the equipment) can operate any one or more components of the linear wellhead connection system 100. For example, an operator can remotely operate the electric or hydraulic coupling system to engage and disengage the connection member 125 and the receiver 126.

A fluid conduit is disposed through each discharge conduit 142, 143, 144, 145, 146 and the corresponding receiver 126 such that pressurized fluid from the inlet conduit 120 may flow through the discharge conduit 142, 143, 144, 145, 146 and the corresponding receiver 126 when coupled together. Although only five discharge conduits are shown, the linear wellhead connection system 100 may be configured to direct pressurized fluid through one, two, three, four, five, six, seven, eight, nine, ten, or more discharge conduits that are each coupled to a corresponding wellhead. A single discharge conduit may be coupled to a single wellhead or multiple wellheads.

Each discharge conduit 142, 143, 144, 145, 146 is fluidly coupled to one of the wellheads 210, 220, 230, 240, 250 via one or more fluid conduits 152, 153, 154, 155, 156. The fluid conduits 152, 153, 154, 155, 156 may comprise one or more flexible hoses, one or more rigid pipes, or a combination of one or more flexible hoses and/or rigid pipes. The fluid conduits 152, 153, 154, 155, 156 direct pressurized fluid from the discharge conduits 142, 143, 144, 145, 146 to the respective wellheads 210, 220, 230, 240, 250.

The linear wellhead connection system 100 may be supported on a frame 160. Specifically, the inlet conduit 120, the discharge conduits 142, 143, 144, 145, 146, the track system 130, and the drive system 137 may all be coupled to the frame 160 and moved as a single unit. The drive system 137 may alternatively not be coupled to the frame 160 and be separately coupled to the track system 130 when the linear wellhead connection system 100 is in place. The flexible hose 110 can be separately coupled to the inlet conduit 120 when the linear wellhead connection system 100 is in place. Similarly, the fluid conduits 152, 153, 154, 155, 156 can be separately coupled to the respective discharge conduits 142, 143, 144, 145, 146 when the linear wellhead connection system 100 is in place.

The receiver 126 of each discharge conduit 142, 143, 144, 145, 146 may be located on a side, such as a front side, of the discharge conduits 142, 143, 144, 145, 146, such that the connection member 125 of the inlet conduit 120 engages the same side of the discharge conduits 142, 143, 144, 145, 146. The fluid conduits 152, 153, 154, 155, 156 may be fluidly coupled to the opposite side, such as the rear side, of the discharge conduits 142, 143, 144, 145, 146. However, the fluid conduits 152, 153, 154, 155, 156 may be fluidly coupled to any of the sides, including the top and the bottom, of the discharge conduits 142, 143, 144, 145, 146.

In one embodiment, the receiver 126 of each discharge conduit 142, 143, 144, 145, 146 may be located on a top side of the discharge conduits 142, 143, 144, 145, 146, and the inlet conduit 120 may be moved laterally (horizontally along the X-axis and/or Y-axis) and lowered/raised (vertically along the Z-axis) into and out of engagement with each discharge conduit 142, 143, 144, 145, 146. For example, the track system 130 may be secured to the frame 160 at a location above the discharge conduits 142, 143, 144, 145, 146 such that the inlet conduit 120 is suspended from the track system 130. The inlet conduit 120 can be moved in a linear direction by the drive system 137 along the primary track 131 (along the X-axis) and then along one of the secondary tracks 132, 133, 134, 135, 136 of the track system 130 (along the Y-axis) to a location above one of the discharge conduits 142, 143, 144, 145, 146. The inlet conduit 120 can then be lowered down (along the Z-axis) such that the connection member 125 engages the receiver 126 of the corresponding discharge conduit 142, 143, 144, 145, 146 to fluidly couple the inlet conduit 120 to the corresponding discharge conduit 142, 143, 144, 145, 146. The inlet conduit 120 may be raised and lowered (along the Z-axis) by a crane of the drive system 137.

Figure 2:
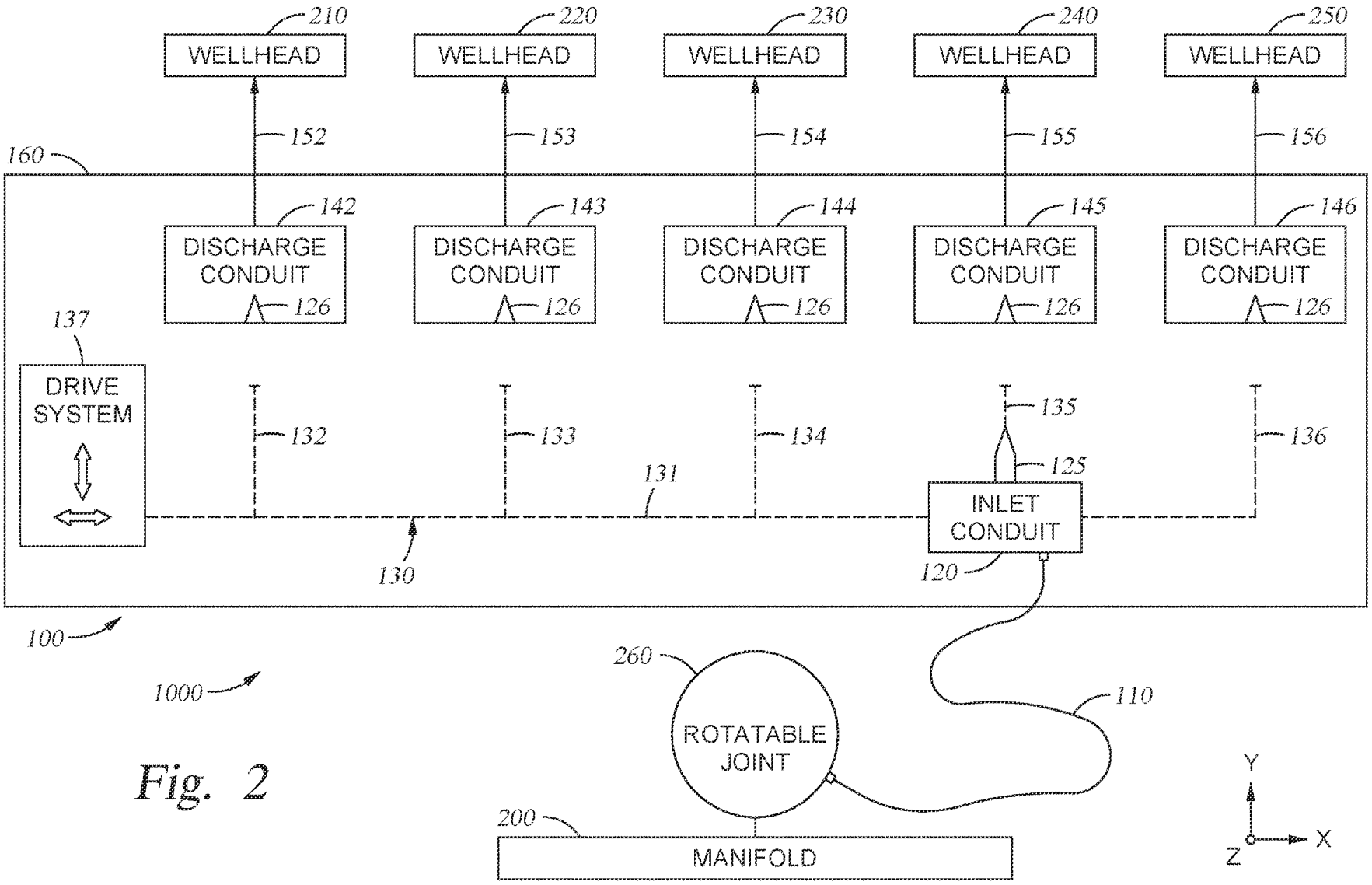
FIG. 2 is a schematic view of the hydraulic fracturing operation with the linear wellhead connection system, and the inlet conduit of the linear wellhead connection system in a second position, according to one embodiment.

FIG. 2 is another schematic view of the hydraulic fracturing operation 1000 with the linear wellhead connection system 100. The inlet conduit 120 has moved linearly along the primary track 131 from a first position as shown in FIG. 1 to a second position as shown in FIG. 2. In the second position, the inlet conduit 120 is in alignment with the secondary track 135 and in front of the discharge conduit 145. The inlet conduit 120 is moved along the primary track 131 by the drive system 137. When moving along the primary track 131, the inlet conduit 120 moves laterally relative to the discharge conduits 142, 143, 144, 145, 146. The flexible hose 110 (with or without the rotatable joint 260) is flexible enough (e.g. by bending and moving) to accommodate for the movement of the inlet conduit 120 from the first position to the second position and remains fluidly coupled to the inlet conduit 120 when moving from the first position to the second position.

Figure 3:
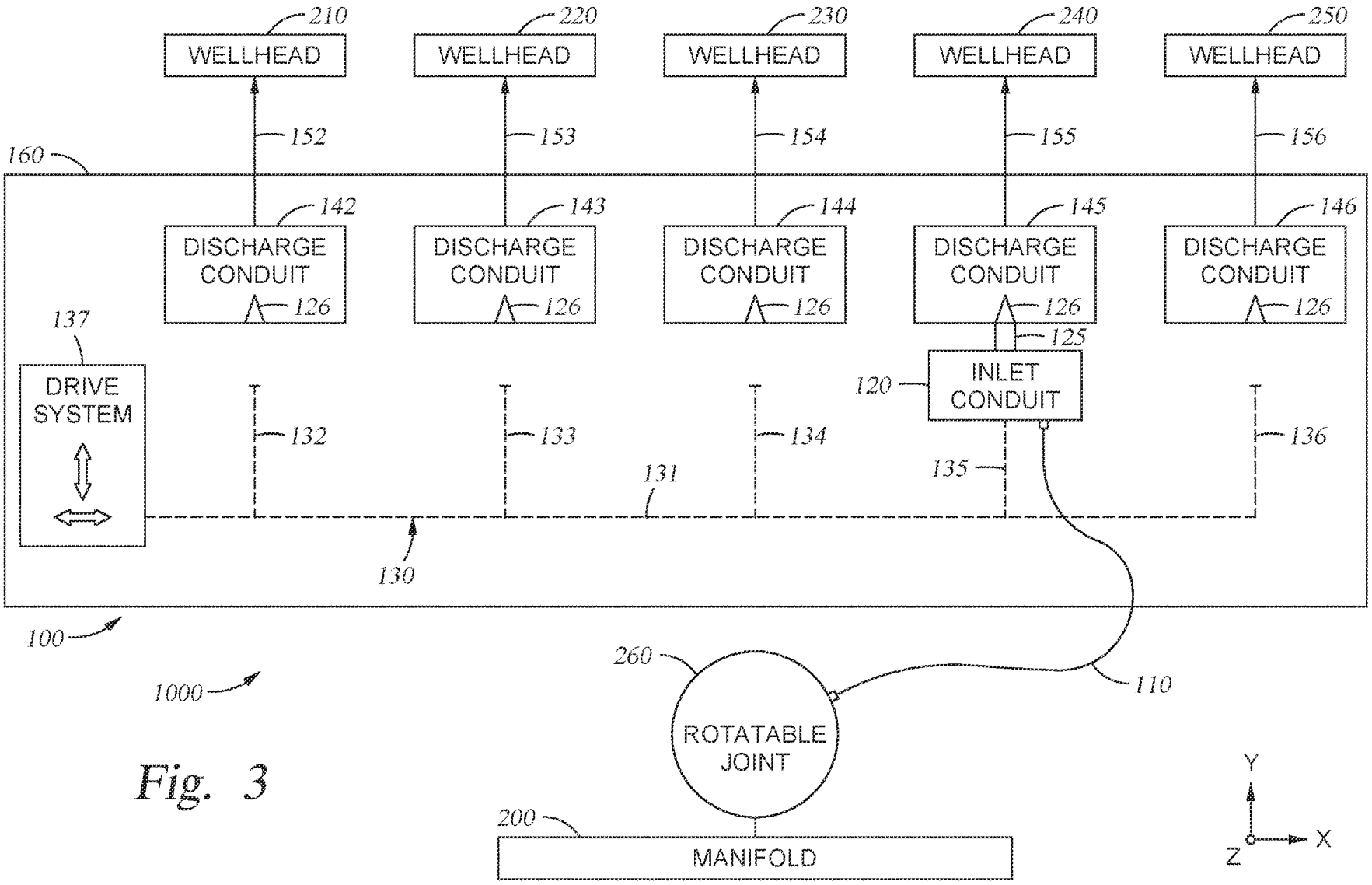
FIG. 3 is a schematic view of the hydraulic fracturing operation with the linear wellhead connection system, and the inlet conduit of the linear wellhead connection system in a third position, according to one embodiment.

FIG. 3 is another schematic view of the hydraulic fracturing operation 1000 with the linear wellhead connection system 100. The inlet conduit 120 has moved linearly along the secondary track 135 from the second position as shown in FIG. 2 to a third position as shown in FIG. 3. In the third position, the connection member 125 of the inlet conduit 120 engages the receiver 126 of the discharge conduit 145. When engaged, the connection member 125 and the receiver 126 form a fluid tight connection between the inlet conduit 120 and the discharge conduit 145 to fluidly couple the inlet conduit 120 to the discharge conduit 145.

The inlet conduit 120 is moved along the secondary track 135 by the drive system 137. When moving along the second track 135 (or any other secondary track), the inlet conduit 120 moves toward and away from the discharge conduits 142, 143, 144, 145, 146. The flexible hose 110 (with or without the rotatable joint 260) is flexible enough (e.g. by bending and moving) to accommodate for the movement of the inlet conduit 120 from the second position to the third position and remains fluidly coupled to the inlet conduit 120 when moving from the second position to the third position.

Pressurized fluid from the manifold 200 can be pumped through the flexible hose 100 (and through the rotatable joint 260 if used) to the inlet conduit 120, and through the discharge conduit 145 to the wellhead 240 via the fluid conduits 155. The inlet conduit 120 can be de-coupled from the discharge conduit 145 by disengaging the connection member 125 from the receiver 126 of the discharge conduit 145. The inlet conduit 120 can then be moved in a linear direction along the secondary track 135, away from the discharge conduit 145 and back onto the primary track 131. The inlet conduit 120 can then be moved in a linear direction along the primary track 131, laterally relative to the discharge conduits 142, 143, 144, 145, 146, to any of the other secondary tracks 132, 133, 134, 136 to engage any of the other discharge conduits 142, 143, 144, 146. This process can be repeated any number of times to pump pressurized fluid from the manifold 200 to any of the wellheads 210, 220, 230, 240, 250.

FIG. 4 is a schematic view of a hydraulic fracturing operation 2000 with a linear wellhead connection system 100, according to one embodiment. The linear wellhead connection system 100 is similar to the system 100 illustrated in FIGS. 1-3. Only a portion of the linear wellhead connection system 100 is illustrated in FIG. 4 and the frame 160 has been removed for clarity. The linear wellhead connection system 100 illustrated in FIG. 4 shows the drive system 137 being coupled directly to the inlet conduit 120. The drive system 137 may be a wheel/motor assembly that moves the inlet conduit 120 into and out of engagement with the discharge conduits, of which only discharge conduits 145, 146 are shown, although any number of discharge conduits can be used.

Referring to FIG. 4, the linear wellhead connection system 100 further includes a plug handling system 300. The plug handling system 300 is illustrated as being coupled to the inlet conduit 120, but the plug handling system 300 can be a separate system that is independently movable relative to the inlet conduit 120. The plug handling system 300 may be a robotic arm that is extendable, retractable, and can grip one or more objects. The discharge conduits 145, 146, when not fluidly coupled to the inlet conduit 120 may have a plug member 310 inserted in or on the receiver 126 to seal fluid flow out of the discharge conduits 145, 146. The plug member 310 can be removed prior to engaging the connection member 125 of the inlet conduit 120 with the receiver 126 of the discharge conduit 142, 143, 144, 145, 146 that is to be engaged with the inlet conduit 120.

Referring to FIG. 5, the plug handling system 300 has removed the plug member 310 from the discharge conduit 145 and has moved to itself and the plug member 310 to a position such that the connection member 125 of the inlet conduit 120 can sealingly engage the receiver 126 of the discharge conduit 145. The plug handling system 300 can then replace the plug member 310 back onto the discharge conduit 145 when the inlet conduit 120 is disengaged from the discharge conduit 145.

In an alternative embodiment, the plug member 310 can be hinged to the discharge conduit 145 such that the plug handling system 300 moves the plug member 310 from a closed position to an open position to allow the inlet conduit 120 to engage the discharge conduit 145. The plug member 310 remains coupled to the discharge conduit 145 but is in an open position. The plug handling system 300 can then move the plug member 310 back to the closed position when the inlet conduit 120 is disengaged from the discharge conduit 145.

In an alternative embodiment, the plug handling system 300 with or without the inlet conduit 120 can move the plug member 310 to another discharge conduit and place the plug member 310 onto that discharge conduit. If the inlet conduit 120 moves with the plug handling system 300, the inlet conduit and the plug handling system 300 are used to remove the plug member 310 from one discharge conduit and then move to another discharge conduit that does not have a plug member 310. The plug handling system 300 can place the plug member 310 onto the discharge conduit that does not have a plug member 310, and then the plug handling system 300 and the inlet conduit 120 can move back to the initial discharge conduit so that the inlet conduit 120 can engage that discharge conduit. Alternatively, the plug handling system 300 can move independently of the inlet conduit 120. For example, the plug handling system 300 can have its own track system and drive system, such as the track system 130 and the drive system 137. The embodiments of the track system 130 and the drive system 137 described herein can equally apply to the plug handling system 300 as a separate system.

Figure 6:
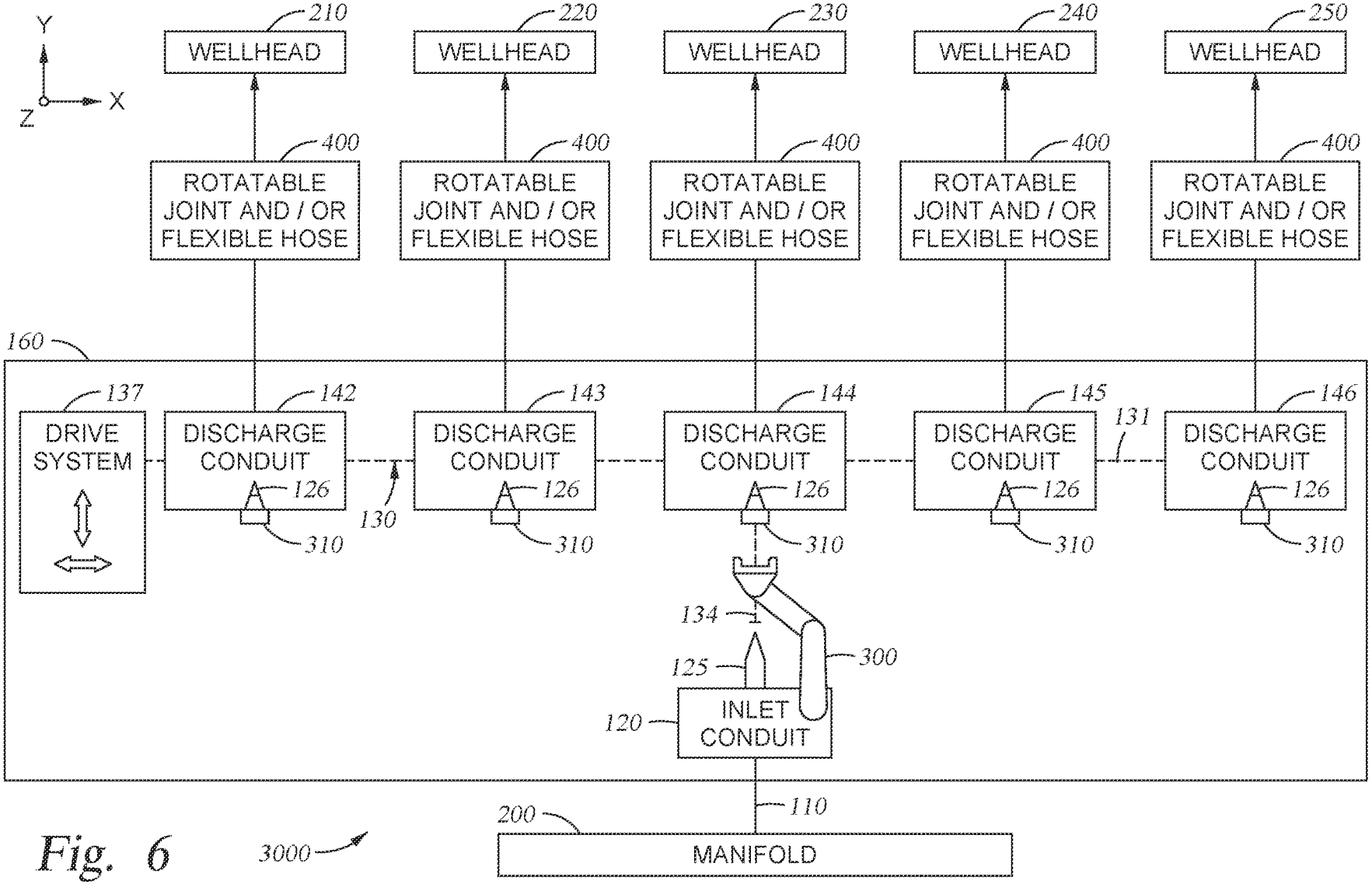
FIG. 6 is a schematic view of the hydraulic fracturing operation with the linear wellhead connection system, according to one embodiment.

FIG. 6 is a schematic view of a hydraulic fracturing operation 3000 with a linear wellhead connection system 100, according to one embodiment. The linear wellhead connection system 100 is similar to the system 100 illustrated in FIGS. 1-5. However, the linear wellhead connection system 100 illustrated in FIG. 6 is configured such that the discharge conduits 142, 143, 144, 145, 146 move in linear directions along the track system 130 into and out of engagement with the inlet conduit 120. Each discharge conduit 142, 143, 144, 145, 146 is fluidly coupled to each wellhead 210, 220, 230, 240, 250 via a rotatable joint and/or a flexible hose 400. The rotatable joint and/or the flexible hose 400 can be similar to the flexible hose 110 and the rotatable joint 260 illustrated in FIG. 1-3. The rotatable joint and/or the flexible hose 400 can comprise any number of swivel joints coupled together to allow for the movement of each discharge conduits 142, 143, 144, 145, 146. The discharge conduits 142, 143, 144, 145, 146 can be moved by the drive system 137. The drive system 137 can be separately coupled to the track system 130 or directly coupled to each discharge conduit 142, 143, 144, 145, 146.

The inlet conduit 120 can be fixed and fluidly coupled to the manifold 200 by the flexible hose and/or hard pipe 110. In one embodiment, both the inlet conduit 120 and the discharge conduits 142, 143, 144, 145, 146 can move relative to each other. For example, the discharge conduits 142, 143, 144, 145, 146 can move along the primary track 131 (along the X-axis) until they are aligned with the secondary track 134. Then either the discharge conduit or the inlet conduit 120 can move along the secondary track 134 (along the Y-axis) into engagement. The discharge conduits 142, 143, 144, 145, 146 and/or the inlet conduit 120 can also be positioned relative to each other at different heights and can be movable vertically (along the Z-axis) if needed. The plug handling system 300 can also be used to remove the plug members 310 from each discharge conduit 142, 143, 144, 145, 146. The plug handling system 300 can be a standalone system, can be coupled to the inlet conduit 120, and/or can be coupled to each discharge conduit 142, 143, 144, 145, 146.

Benefits of the present disclosure include rapidly and effectively establishing connections to a plurality of wellheads using a single flexible wellhead hose, reduced line lengths for wellhead hoses and second hoses, reduced numbers and complexities of connection points for wellhead connection systems to pump high pressure fluid into wells (such as wells of a multi-well pad using zipper frac), reduced complexity, and reduced numbers of lines. Benefits of the present disclosure also include increased efficiency, reduced costs, reduced operational times, decreased mobilization of resources, and simplicity in design and operations.

It will be appreciated by those skilled in the art that the preceding embodiments are exemplary and not limiting. It is intended that all modifications, permutations, enhancements, equivalents, and improvements thereto that are apparent to those skilled in the art upon a reading of the specification and a study of the drawings are included within the scope of the disclosure. It is therefore intended that the following appended claims may include all such modifications, permutations, enhancements, equivalents, and improvements. The present disclosure also contemplates that one or more aspects of the embodiments described herein may be substituted in for one or more of the other aspects described. The scope of the disclosure is determined by the claims that follow.

The invention claimed is:

1. A linear wellhead connection system, comprising:

a plurality of discharge conduits, wherein each discharge conduit is in fluid communication with at least one wellhead, and wherein each discharge conduit has a receiver;

an inlet conduit, wherein the inlet conduit has a connection member engageable with the receiver on each discharge conduit to fluidly couple the inlet conduit to the discharge conduit, and wherein the inlet conduit is moveable relative to each discharge conduit to engage and disengage the connection member of the inlet conduit to and from the receiver of any one of the discharge conduits;

a track system, wherein the inlet conduit is movable along the track system to engage and disengage the connection member to and from the receiver of any one of the discharge conduits;

a flexible hose fluidly coupled to the inlet conduit, wherein the flexible hose remains coupled to the inlet conduit when the inlet conduit is moved along the track; and a pressurized fluid source in fluid communication with the flexible hose to supply pressurized fluid to the inlet conduit.

2. The linear wellhead connection system of claim 1, further comprising a rotatable joint in fluid communication with the pressurized fluid source and fluidly coupled to the flexible hose.

3. The linear wellhead connection system of claim 1, wherein the inlet conduit is movable along the track system in a linear direction to engage and disengage the connection member to and from the receiver of any one of the discharge conduits.

4. The linear wellhead connection system of claim 3, wherein the inlet conduit is moveable along a primary track of the track system laterally relative to the discharge conduits, wherein the inlet conduit is moveable along a secondary track of the track system toward and away from the discharge conduits, and wherein the flexible hose remains coupled to the inlet conduit as the inlet conduit moves along the primary and secondary tracks of the track system.

5. The linear wellhead connection system of claim 1, further comprising a drive system configured to move the inlet conduit, wherein the drive system is directly or indirectly coupled to the inlet conduit.

6. The linear wellhead connection system of claim 1, further comprising a frame, wherein the discharge conduits and the inlet conduit are supported on the frame and movable together as a single unit.

7. The linear wellhead connection system of claim 1, further comprising a plug handling system configured to remove a plug member from each discharge conduit.

8. The linear wellhead connection system of claim 1, wherein the connection member of the inlet conduit and the receiver of the discharge conduits comprise an electric, hydraulic, or manual coupling system.

9. A linear wellhead connection system, comprising:

a plurality of discharge conduits, wherein each discharge conduit is in fluid communication with at least one wellhead, and wherein each discharge conduit has a receiver;

an inlet conduit, wherein the inlet conduit has a connection member engageable with the receiver on each discharge conduit to fluidly couple the inlet conduit to the discharge conduit, and wherein the discharge conduits are moveable relative to the inlet conduit to engage and disengage the receiver of any one of the discharge conduits with the connection member of the inlet conduit;

at least one flexible hose fluidly coupled to the discharge conduits and configured to direct pressurized fluid the at least one wellhead, wherein the at least one flexible hose remains coupled the discharge conduits when the discharge conduits are moved; and a pressurized fluid source in fluid communication with the inlet conduit to supply pressurized fluid.

10. The linear wellhead connection system of claim 9, further comprising at least one rotatable joint in fluid communication with the at least one wellhead and fluidly coupled to the at least one flexible hose.

11. The linear wellhead connection system of claim 10, further comprising a track system, wherein the discharge conduits are movable along the track system in a linear direction to engage and disengage the receiver of any one of the discharge conduits with the connection member of the inlet conduit.

12. A method of pumping fluid into a plurality of wellheads, comprising:

moving an inlet conduit along a track system and relative to a plurality of discharge conduits, wherein a flexible hose remains fluidly coupled to the inlet conduit as the inlet conduit moves along the track system;

engaging a connection member of the inlet conduit with a receiver of a first discharge conduit of the plurality of discharge conduits to fluidly couple the inlet conduit with the first discharge conduit; and pumping pressurized fluid through the flexible hose, the inlet conduit, and the first discharge conduit into a first wellhead that is in fluid communication with the first discharge conduit.

13. The method of claim 12, further comprising:

disengaging the connection member of the inlet conduit with the receiver of the first discharge conduit to de-couple the inlet conduit from the first discharge conduit; and moving the inlet conduit along the track system toward a second discharge conduit of the plurality of discharge conduits.

14. The method of claim 13, further comprising:

engaging the connection member of the inlet conduit with a receiver of the second discharge conduit to fluidly coupled the inlet conduit with the second discharge conduit; and pumping pressurized fluid through the flexible hose, the inlet conduit, and the second discharge conduit into a second wellhead that is in fluid communication with the second discharge conduit.

15. The method of claim 12, wherein the inlet conduit moves linearly along a primary track of the track system and laterally relative to the plurality of discharge conduits, and wherein the inlet conduit moves linearly along a secondary track of the track system and toward the first discharge conduit of the plurality of discharge conduits.

16. The method of claim 15, further comprising moving the inlet conduit along the primary and secondary tracks of the track system by a drive system that is coupled directly or indirectly to the inlet conduit.

17. The method of claim 12, further comprising pumping pressurized fluid through a rotatable joint that is fluidly coupled to the flexible hose, wherein one end of the flexible hose is fluidly coupled to the rotatable joint and an opposite end of the flexible hose is fluidly coupled to the inlet conduit.

18. The method of claim 12, further comprising a frame, wherein the discharge conduits, the track system, and the inlet conduit are supported on the frame and movable together as a single unit.

19. The method of claim 12, wherein the first discharge conduit is fluidly coupled to the first wellhead by one or more flexible hoses, one or more hard pipes, or a combination thereof.

20. The method of claim 12, wherein the connection member of the inlet conduit and the receiver of the discharge conduits comprise an electric, hydraulic, or manual coupling system.

* * * * *